US005735002A

United States Patent [19]

Kistner

[11] Patent Number: 5,735,002

[45] Date of Patent: Apr. 7, 1998

[54] APPARATUS FOR ASSISTING A PERSON MOVING BETWEEN SUPPORT SURFACES

[76] Inventor: James W. Kistner, 6954 Lois Dr., Cincinnati, Ohio 45239

[21] Appl. No.: 726,274

[22] Filed: Oct. 4, 1996

[51] Int. Cl.[6] ..... A61G 7/10; A61G 7/053

[52] U.S. Cl. ..... 5/81.1 HS

[58] Field of Search ..... 5/81.1 HS, 81.1 R; 4/578.1, 579; 414/921

[56] References Cited

U.S. PATENT DOCUMENTS

| | | | |
|---|---|---|---|
| 2,588,562 | 3/1952 | Parish | 4/579 |
| 2,696,246 | 12/1954 | Putnam | 297/232 |
| 2,852,785 | 9/1958 | Mikola | 4/579 |
| 3,638,997 | 2/1972 | Shapiro et al. | 297/232 |
| 3,949,436 | 4/1976 | Fawess . | |
| 3,962,736 | 6/1976 | Fedele | 5/81.1 HS |
| 4,168,549 | 9/1979 | Davies . | |
| 4,644,594 | 2/1987 | Johnson | 5/81.1 HS |
| 4,939,799 | 7/1990 | Van Hovel | 4/578.1 |
| 5,282,284 | 2/1994 | Brantman | 5/81.1 HS |

*Primary Examiner*—Alexander Grosz
*Attorney, Agent, or Firm*—Wood, Herron & Evans, LLP

[57] ABSTRACT

A transfer apparatus for assisting a person when moving between support surfaces comprising a planar base structure spanning between a first surface and a second surface and a planar person-supporting platform configured for receiving a person thereon. A slidable bearing structure couples the platform with the base structure and the platform slides in a first direction with respect to the base structure to move a person on the platform from said first surface to said second surface positioned away from said first surface. A locking device coupled between the base structure and the platform prevents the platform from moving in a second direction opposite said first direction such that a person on the platform may move from the first surface to the second surface without losing progress made toward the second surface.

17 Claims, 2 Drawing Sheets

APPARATUS FOR ASSISTING A PERSON MOVING BETWEEN SUPPORT SURFACES

FIELD OF THE INVENTION

The present invention relates generally to an apparatus for assisting disabled persons and specifically is a device which assists disabled persons to move from one support surface to another support surface.

BACKGROUND OF THE INVENTION

There are a large number of disabled or physically challenged persons which use a wheelchair as a means for assisting their mobility, either on a permanent basis or temporarily. In any case, such persons must seat themselves in the wheelchair and often must move to the wheelchair from a seated position on another support surface, such as a chair, couch or bed. When use of the wheelchair is complete, they may want to return to a seated position on the piece of furniture or bed. If they are unable to stand up to move between the support surfaces, such as if their legs are not able to provide the support they need to allow them to raise themselves off of one surface and sit back down on the other surface, they will usually have to slide or scoot to and from the wheelchair.

Because of their construction, wheelchairs usually cannot be placed directly next to a support surface in the exact orientation required for the person to easily slide to or from the chair and make the transition. Oftentimes, a gap of free space is left between the wheelchair and the other surface over which the person must somehow move. This will be difficult or virtually impossible, depending upon the physical capabilities of the person.

For example, when the wheelchair is placed next to a couch, the person usually cannot slide or scoot directly into the seat of the wheelchair from the couch, because he is blocked by the arms of the wheelchair. As may be appreciated, such a transition will require the person to use their arms and upper body strength to lift and pull or push themselves from the seated position on the wheelchair or furniture, over the gap, over any other obstacles and then onto another surface. The weight of the person against the furniture or wheelchair surface provides a substantial amount of friction and hinders them from making a smooth transition between surfaces. Furthermore, the amount of weight which must be lifted and moved complicates the transition, despite the person having adequate arm movement and upper body strength for other tasks. There is a definite possibility that the person could fall onto the floor during such a task, causing a significant inconvenience, if not injury. Still further, if the person cannot make the transition themselves, they may need the help of an assistant to do so. While family members may be available to help, such a scenario is not guaranteed or convenient. If no family members live with the disabled person, they may have to go to the substantial expense of hiring an assistant.

One simple attempt to assist a person in moving from a surface to a wheelchair has been in the form of a board which spans the free space between two surfaces, i.e., the wheelchair and another seat surface. The person then pushes themselves onto the board and scoots across the board. This task, however, is still difficult because it requires a substantial amount of upper body strength due to the friction between the board and the person's clothing. Also, if the friction is too great, the board may be pulled away from one of the support surfaces, again leaving the person on the floor. Furthermore, if the surface to be moved to is higher than the present surface on which the person rests, the difficulty is increased. In such a case, one end of the board is higher than the other and the person has to push or pull their body uphill. If they stop and rest in such a scenario, they may have a tendency to slide back down the board and lose the forward progress they had made.

As a result, the prior art attempts have not been adequate to provide suitable assistance to a disabled person in moving between a wheelchair and a seating surface. Such a solution is particularly inadequate in the situation where the person needing assistance does not have a great amount of upper body strength.

Accordingly, the prior art does not address the needs of persons who use wheelchairs, and there is a need for an apparatus to enhance the mobility of such wheelchair users.

It is thus an objective of the present invention to assist wheelchair users in moving to and from their wheelchairs.

It is another objective of the invention to assist wheelchair users who do not have a great amount of upper body strength to move to and from their wheelchairs.

It is still another objective to provide a means which may be as easily used to move from a wheelchair to another seating surface as it is to move from the seating surface back to the wheelchair.

It is another objective of the invention to ensure that any energy expended to make the transition between a wheelchair and a seating surface is not wasted or lost if the person has to rest while making the transition.

These objectives and the needs in the prior art are addressed by the present invention as discussed further hereinbelow.

SUMMARY OF THE INVENTION

The present invention comprises an apparatus for assisting a disabled person when moving between two support surfaces, such as a wheelchair and a piece of furniture or a bed. The invention thus enhances the mobility of wheelchair users while assisting such users in moving to and from their wheelchairs. The present invention provides such assistance without requiring a great amount of upper body strength on behalf of the user. Furthermore, the invention may be as easily used to move from the wheelchair to a seating surface as it is to move from the seating surface back to the wheelchair, and ensures that the energy expended to make the transition in one direction is not wasted by backsliding in the opposite direction.

More specifically, the apparatus of the invention comprises a planar base structure which has ends that are configured to rest on a firm surface, such as the seating surface of a couch or a wheelchair. The base structure spans between the wheelchair and the other surface and is configured to provide a stable base for the apparatus to prevent rocking thereof. A planar person-supporting platform is configured for receiving a person thereon and is slidably coupled to the base structure by a sliding bearing structure for low friction movement of the platform with respect to the base structure.

More particularly, the support platform is a planar piece which is mounted on top of and preferably co-extensively with the base. The support platform slides forward and backward in a direction parallel to the longitudinal axis of the base structure. The planar members of the apparatus are approximately 8 inches to 8¼ inches wide, to provide a stable structure on which a person may move and also to provide a suitable width for a seat on the platform.

In a preferred embodiment, the base and platform are each approximately 23½ inches long and, in the rest or start position, the platform overlies the base, which is positioned to span over a gap between the wheelchair and another seating surface. The person then scoots from their seating surface, e.g., a couch, onto the support platform and pushes or pulls themselves to slide the support platform with respect to the base in a first direction from the seating surface toward the wheelchair or vice versa. The top platform slides smoothly with respect to the base structure in the first direction, and therefore, the person moves freely from one seating surface to another seating surface without expending a great amount of effort. When the platform is in the extended or finish position, the person overlies the new seating surface and may simply scoot off of the support platform onto that surface.

With the invention, there is little or no friction created between the support platform and the person's clothing because the person remains generally stationary on the support platform which, in turn, slides easily with respect to the base. In a preferred embodiment of the invention, the base and support platform are formed of a lightweight yet strong material, such as wood, plastic or a lightweight metal. A series of guides and tracks respectively coupled to the base and platform ensure that the motion is generally along a straight line between the support surfaces. This improves the stability of the apparatus when it is propped up between the surfaces. The smooth slide of the support platform prevents the base from being pulled away from one of the surfaces and falling to the ground.

To further enhance the transition of a person between a wheelchair and another surface, the apparatus of the present invention comprises a locking device coupled between the base structure and the platform. The locking device allows the platform to slide freely in the forward direction but prevents the platform from moving in a backward direction once it has progressed in the forward direction. In that way, a person's forward progress with the invention is not lost, and the strength of the person can be dedicated solely to moving the support platform, as opposed to moving the platform and then maintaining it in its forward position. The person may move the platform a small amount, rest and then move the platform again, without backsliding or losing progress.

One embodiment of the locking device comprises a rack gear mounted on the base structure and a latch depending downwardly from the support platform and engaging the rack gear. The latch is pivotably mounted on the support platform and swings down to engage the rack gear. When the platform is moved in the first direction toward the new seating surface on which the person desires to sit, the latch pivots up and down and rides over the rack gear falling over and between each successive gear tooth. The latch, however, does not pivot over the gear teeth when the support is moved in a direction opposite to the forward direction in which the person is progressing. Therefore, the latch holds the support platform in its forwardmost position so that forward progress is not lost. When the person has reached the new seating surface they desire, they simply scoot off of the support platform onto the seating surface.

To move the support platform back to the rest position after use, such as to prepare the apparatus for transfer to another seating surface, the entire apparatus is inverted such that the latch swings away from the rack gear under the influence of gravity to allow the support platform to be moved in a backward direction on the base. In that way, the apparatus is again ready to be used.

The above and other objectives and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
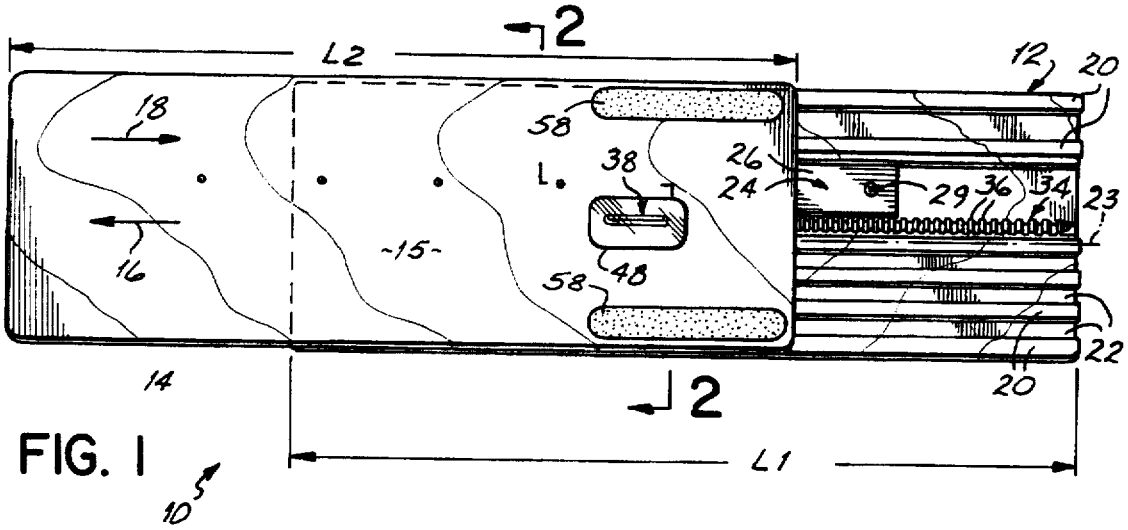
FIG. 1 is a top perspective view of an embodiment of the invention shown partially moved from the rest or start position.

FIG. 1 illustrates a top view of the apparatus 10 of the invention which comprises a base structure or, base 12 and a support platform 14. Base structure 12, in the embodiment illustrated in FIG. 1, is generally planar having a thickness T1 in the range of ⅜ inch to ½ inch and a length L1 in a range of 23½ inches to 24 inches. Support platform 14 is similarly dimensioned having a thickness T2 in the range of ⅜ inch to ½ inch and a length L2 in the range of 23½ inches to 24 inches. It will be readily understood by a person ordinarily skilled in the art that the thickness and length dimensions are for one preferred embodiment, and other dimensions might be utilized without departing from the scope of the invention. For example, certain wheelchairs may require further spacing from a piece of furniture than do other wheelchairs. The base 12 and platform 14 might be formed of a lightweight yet strong material such as wood, plastic, or a lighweight metal.

Support platform 14 overlies the base structure 12 and slides longitudinally thereon in a forward or first direction indicated by arrow 16, which is essentially parallel to the longitudinal axis 23 of the base 12. In operation, apparatus 10 is placed between two seating surfaces, such as a couch, and the seat of a wheelchair. The base 10 spans between the surfaces. The person then moves to sit on the support platform 14 and slides in the forward direction 16 to move from one seating surface to the other seating surface as described further hereinbelow (see FIGS. 4 and 5).

Figure 2:
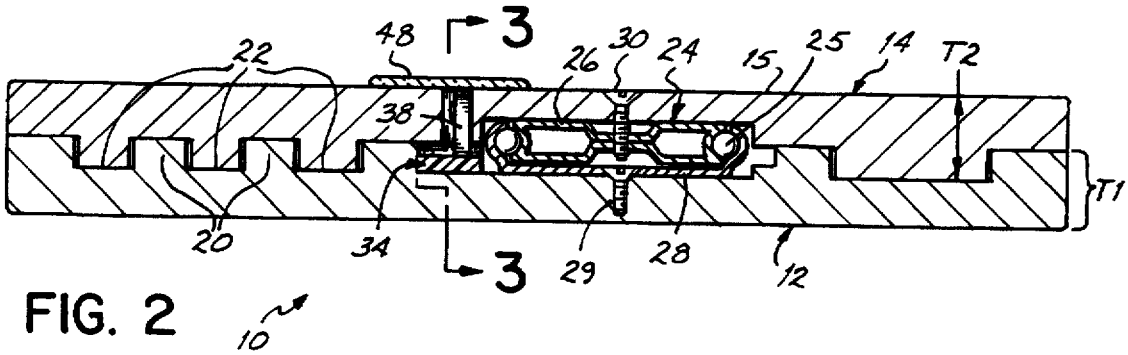
FIG. 2 is a cross-sectional view than a long line 2—2 of FIG. 1 of the embodiment illustrated in FIG. 1.
Figure 4:
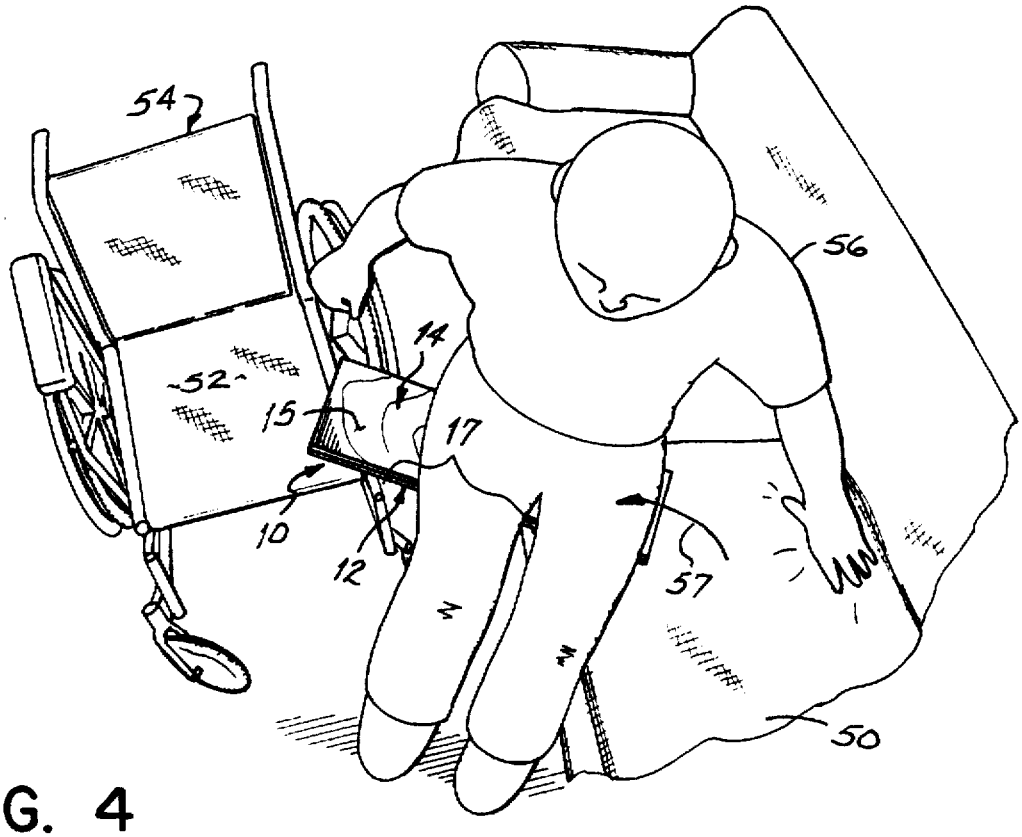
FIG. 4 is a top perspective view showing use of the invention with a person in the start position on a seating surface.

In a rest or start position, the support platform overlies base 12 and is generally co-extensive therewith (see FIG. 4). As such, the apparatus 10 is portable and may be easily positioned between seating surfaces to assist a disabled or physically challenged person to move between the surfaces. Referring to FIG. 4, the positioned apparatus, and particularly base 12, spans the gap 17 of free space which will exist between the wheelchair 54 and the couch 50. As seen in FIG. 1, a series of alternating guides 20 on the base structure fit within corresponding grooves 22 formed in the support platform. Similarly, guides 20 on the support platform fit within grooves 22 formed in the base structure (see FIG. 2). In that way, support platform 14 slides longitudinally with respect to base 12 without deviating from side to side. The person on the platform will thus move in a generally straight line from one seating surface to the next. This prevents any side-to-side movement of the platform with respect to the base which tends to stabilize the apparatus in use.

Apparatus 10 of the present invention further comprises a low friction bearing structure, such as a track bearing 24, which is coupled between the base structure 12 and the support platform 14. Track bearing 24 includes a pair of opposing tracks 26, 28 which are coupled respectively to the base or platform by fasteners, such as screws 29, 30. The tracks 26, 28 slide longitudinally with respect to one another. Ball bearings 25 may exist between the tracks for smoother sliding. Track bearing 24 is a suitable commercially available bearing structure which provides smooth, low friction, sliding movement between the base 12 and platform 14. Bearing 24 provides a smooth sliding movement of the apparatus 10 while the corresponding grooves 20 and guides 22 ensure aligned longitudinal movement between the base and platform. Track bearing 24 will normally include stop structures (not shown), which limit the movement of one of the bearings tracks with respect to the other track, in both directions, to prevent uncoupling of the tracks.

One of the particularly beneficial features of the invention is that it may be used to transport a disabled or physically challenged person in the forward or first direction 16 with minimal effort and will maintain the forward progress made so that all the exertion and effort of a person using the invention is for movement in the forward direction 16 and not simply to maintain the progress and prevent backsliding. To that end, the present invention further comprises a locking device coupled between the base structure and the platform which is operable for allowing the platform 14 to slide freely in the forward direction 16 while preventing the platform from moving in the second or backward direction. The embodiment of the locking device illustrated in the figures includes a rack gear 34 which is positioned on base 12. Rack gear 34 includes a plurality of spaced upstanding teeth 36. The locking device further comprises a pivoting latch arm or latch 38 which pivots from an axis 40 on platform 14.

Figure 3:
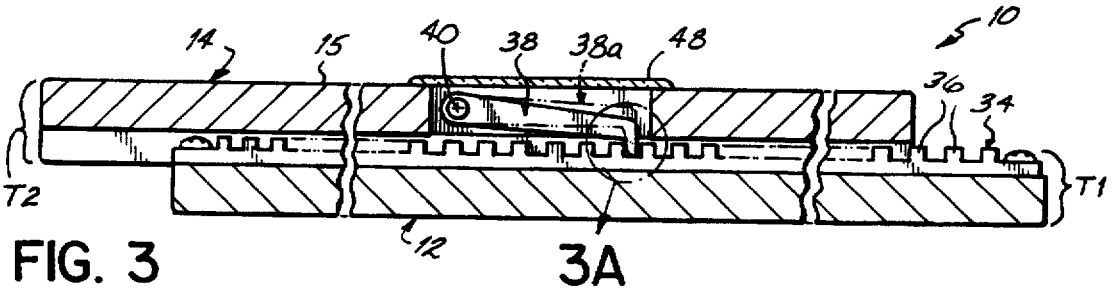
FIG. 3 is a cross-sectional view taken along lines 3—3 of FIG. 2.

Latch 38 pivots downwardly under the force of gravity and includes a downwardly directed foot portion 42 which slides over and between successive gear teeth 36 and drops into a groove or space therebetween. Referring to FIG. 3, the pivot axis of latch 38 is placed forwardly of foot portion 42 so that as platform 14 moves in a forward direction 16, the foot portion 42 is pushed upwardly by the gear teeth 36 to generally disengage from the rack gear 34 as illustrated in phantom by reference numeral 38A. Preferably, the forwardly facing edge 43 of foot portion 42 of latch 38 is slightly rounded to provide smooth forward and upward movement of the latch over the successive gear teeth 36. In that way, latch 38 ratchets up and over the teeth of the rack gear 34 and falls into the successive grooves therebetween to maintain the forward sliding progress of platform 14 (see FIG. 3A).

Figure 3A:
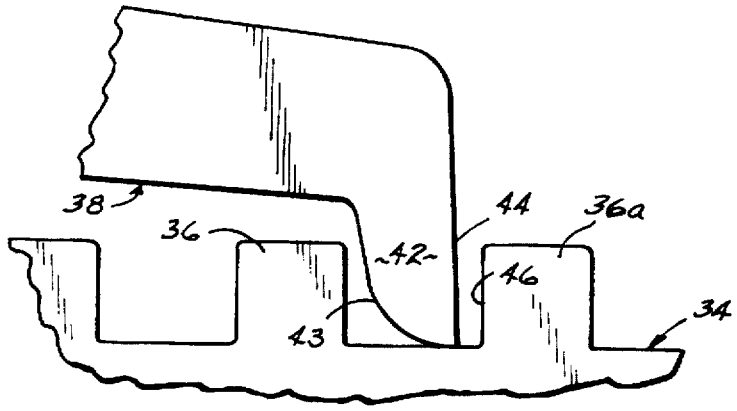
FIG. 3A is an enlarged or the encircled area 3A view of the latch and gear assembly of the invention.

To prevent loss of progress and inadvertent back sliding in the backward direction 18 when apparatus 10 is being used, foot portion 42 includes a flattened rearwardly facing edge 44 which engages a flat edge 46 of the tooth 36A directly rearward of the latch (see FIG. 3A). In that way, edges 44 and 46 abut and prevent the latch from swinging upwardly to slide rearwardly back over tooth 36A. The latch maintains the platform in its forwardmost position. The backward sliding of platform 14 is thus prevented and a person using apparatus 10 of the invention only has to focus on forward progress of platform 14 and does not have to worry about backsliding and losing the progress that has been made. The present invention is particularly helpful to someone who does not have a lot of upper body strength or stamina and may only have enough energy to push themselves forward in increments.

Platform 14 is thus moved forwardly over base 12 to provide assistance to a disabled or physically challenged person moving between seating surfaces. As illustrated in FIG. 3, latch 38 pivots within an opening formed in platform 14, and thus may require pivoting over the top surface 15 of the platform depending upon the height of teeth 36. To that end, a raised cover 48 might be positioned on platform 14 to provide a wider range of pivoting motion. The profile of cover 48 would generally be so low so as not to hinder or disturb the person sitting on platform 14.

Figure 5:
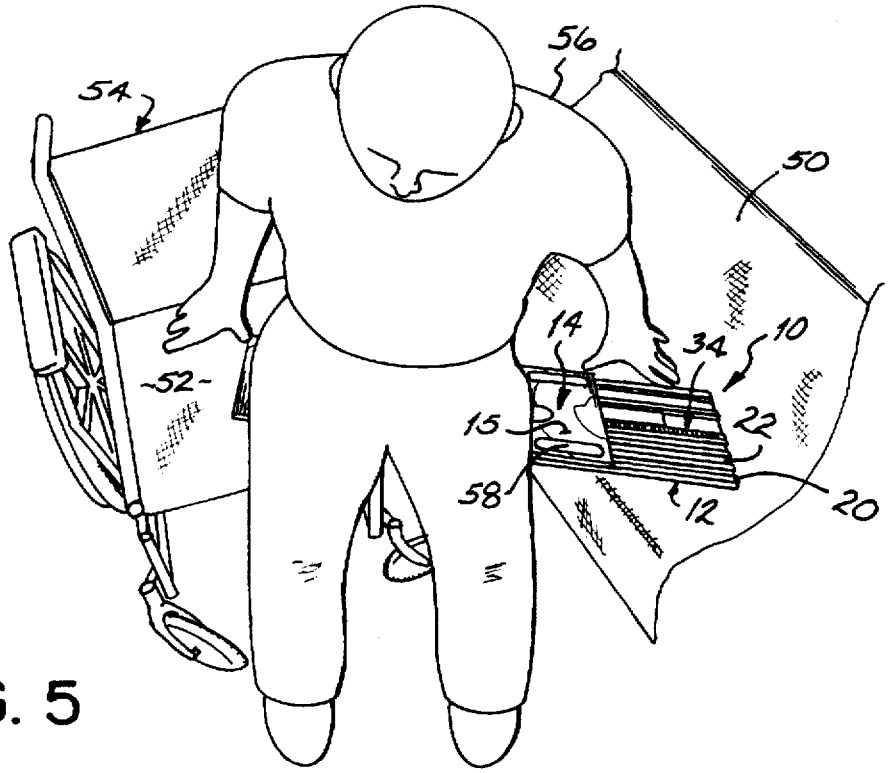
FIG. 5 is a perspective view, similar to FIG. 4, with the person in the finish position over a wheelchair.

FIGS. 4 and 5 illustrate use of apparatus 10 of the invention by a person moving from a seating surface, such as a couch 50 into the seat 52 of wheelchair 54. As illustrated in FIG. 4, apparatus 10, and specifically, base 12 is positioned to span over the space 17 between couch 50 and seat 52. A person 56 then slides or lifts themselves from the couch 50 onto platform 14 of apparatus 10 as indicated by arrow 57. Referring to FIG. 1, platform 14 may contain friction elements, such as sandpaper or grit sheets 58, which keep the person 56 from sliding back off of platform 14, once they are on it.

Turning now to FIG. 5, the person pushes themselves from couch 50 and/or pulls themselves toward the wheelchair 54. Support platform 14 slides smoothly and easily over base 12 to move the person 56 closer to the wheelchair seat 52. In doing so, the latch 38 ratchets over gear teeth 36 and successively locks the support platform into each new forward position. In that way, the person 56 moves to the wheelchair 54 without a great amount of effort and without constantly having to exert a pushing pressure on couch 50 or a pulling pressure on the wheelchair 54 to maintain the forward progress and prevent backsliding. If a person tires during the transition, the person may simply rest without fear of backsliding. Bearing 24 of the invention ensures that support platform 14 glides easily with only a slight scooting motion. When support platform 14 is slid far enough over so that person 56 is overlying a portion of the wheelchair seat 52 (the finish position), the person simply pushes themselves from support platform 14 onto the seat. As illustrated in FIG. 5, a person may need to slide themselves slightly on the platform 14 to ultimately reach a comfortable position on seat 52. The amount of exertion needed to slide platform 14 of the invention is very minimal compared to the amount of exertion and upper body strength which might be required for the person to slide on a flat board or to physically lift themselves from couch 50 onto seat 52, if such a maneuver is even possible.

The present invention thus assists a disabled or physically challenged person to move from one seating surface to another seating surface. While FIGS. 4 and 5 illustrate apparatus 10 being used to go from a couch to a wheelchair, the invention might as easily be used to go from the wheelchair to a couch. As will be appreciated, one surface may be slightly raised with respect to the other surface and, therefore, the person will be moving uphill. In the past, such a maneuver was very difficult and required an exertion or strength level which many disabled or physically challenged persons could not handle. With the present invention, however, the transition is made very easily even uphill and the unique locking device of the invention prevents loss of progress and backsliding. The amount of exertion in moving between surfaces is substantially decreased.

One preferable embodiment of the apparatus utilizes base 12 and platform 14 fabricated out of wood. However, a synthetic material such as plastic might also be utilized if it is of sufficient strength. A lightweight metal, such as aluminum, might also be suitable. Apparatus 10 is portable and easy to use and may be used to span between a variety of seating surfaces.

After the apparatus has been used to move from one seating surface to another, the platform 14 will be extended from the base and locked in the finish or extended position by the locking device. To disengage latch 38, the entire apparatus 10 is simply inverted so that the latch 38 falls under the force of gravity away from rack gear 34. Thereby, the platform may be slid in the backward direction 18 back to the start position to again be generally co-extensive with base 12. Cover 48 prevents the latch 38 from falling too far away from the support platform to prevent it from catching on clothing or some other surface.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A transfer apparatus for assisting a person when moving between support surfaces comprising:

a base structure configured to span between a first surface and a second surface;

a person-supporting platform configured for receiving a person thereon;

a slidable structure coupling the person-supporting platform with the base structure, the platform operable for slidably moving in a first direction with respect to the base structure to move a person on the platform from said first surface to said second surface positioned away from said first surface;

a locking device coupled between the base structure and the platform and operable for allowing the platform to slide freely in said first direction but preventing the platform from moving in a second direction opposite said first direction such that a person on the platform may move from the first surface to the second surface without losing progress made toward the second surface.

2. The transfer apparatus of claim 1 wherein the base structure is generally planar for resting on a generally planar first surface.

3. The transfer apparatus of claim 1 wherein the support platform is generally planar.

4. The transfer apparatus of claim 1 wherein the support platform is coupled to slide on top of the base structure.

5. The transfer apparatus of claim 1 wherein the base structure and support platform are generally planar and the support platform is coupled to slide on top of the base structure.

6. The transfer apparatus of claim 1 wherein the locking device comprises a rack gear resting between the base structure and the support platform and a latch engaging the rack gear, the latch moving over the rack gear when the platform is moved in the first direction and engaging the rack gear to prevent the platform from moving in the second direction.

7. The transfer apparatus of claim 6 wherein the latch includes a portion which falls between successive teeth of the rack gear as the platform moves in the first direction and engages one of said teeth to prevent the platform from moving in the second direction.

8. The transfer apparatus of claim 6 wherein the latch is gravity actuated for disengaging from the rack gear when the apparatus is inverted for allowing the platform to move in said second direction.

9. The transfer apparatus of claim 1 wherein the locking device is gravity actuated when the apparatus is inverted for allowing the platform to move in said second direction.

10. The transfer apparatus of claim 1 wherein the base structure includes one of a groove and a guide which couples with one of a guide which couples with one of a guide and a groove in the platform for guiding the sliding movements of the platform on the base structure.

11. The transfer apparatus of claim 1 wherein the slidable structure comprises a track bearing including two opposing tracks which slide together.

12. A transfer apparatus for assisting a person when moving between support surfaces comprising:

a base structure configured to span between a first surface and a second surface;

a person-supporting platform configured for receiving a person thereon;

a slidable bearing structure coupling the person-supporting platform with the base structure, the platform operable for slidably moving in a first direction with respect to the base structure to move a person on the platform from said first surface to said second surface positioned away from said first surface;

a locking device coupled between the base structure and the platform the locking device comprising a rack gear between the base structure and platform and latch engaging the rack gear, the latch moving over the gear and operable for allowing the platform to slide freely in said first direction but engaging the gear and preventing the platform from moving in a second direction opposite said first direction such that a person on the platform may move from the first surface to the second surface without losing progress made toward the second surface.

13. The transfer apparatus of claim 12 wherein the base structure and support platform are generally planar and the support platform is coupled to slide on top of the base structure.

14. The transfer apparatus of claim 12 wherein the latch includes a portion which falls between successive teeth of the rack gear as the platform moves in the first direction and engages one of said teeth to prevent the platform from moving in the second direction.

15. The transfer apparatus of claim 12 wherein the base structure includes one of a groove and a guide which couples with one of a guide which couples with one of a guide and a groove in the platform for guiding the sliding movements of the platform on the base structure.

16. A transfer apparatus for assisting a person when moving between support surfaces comprising:

a planar base structure configured to span between a first surface and a second surface;

a planar person-supporting platform configured for receiving a person thereon;

a slidable bearing structure coupling the planar person-supporting platform with the planar base structure, the platform operable for slidably moving in a first direction with respect to the base structure to move a person on the platform from said first surface to said second surface positioned away from said first surface;

a locking device coupled between the base structure and the platform, the locking device operable for allowing the platform to slide freely in said first direction but preventing the platform from moving in a second direction opposite said first direction such that a person on the platform may move from the first surface to the second surface without losing progress made toward the second surface.

17. The transfer apparatus of claim 16 wherein the base structure includes one of a groove and a guide which couples with one of a guide and a groove in the platform for guiding the sliding movements of the platform on the base structure.

* * * * *

UNITED STATES PATENT AND TRADEMARK OFFICE

CERTIFICATE OF CORRECTION

PATENT NO. : 5,735,002

DATED : April 7, 1998

INVENTOR(S) : James W. Kistner

It is certified that error appears in the above-identified patent and that said Letters Patent is hereby corrected as shown below:

In Column 4, line 16, delete "than a long line" and insert --taken along a line--.

Column 4, line 47, delete "lighweight" and insert --lightweight--.

Column 8, line 9, delete "fails" and insert --falls--.

Column 8, line 21, in claim 10, delete the second repetition of "which couples with one of a guide".

Column 8, line 61, in claim 15, delete the second repetition of "which couples with one of a guide".

Signed and Sealed this

Fifteenth Day of December, 1998

Bruce Lehman

*Attest:*

BRUCE LEHMAN

*Attesting Officer*

*Commissioner of Patents and Trademarks*